US006579840B1

(12) United States Patent
Heltovics

(10) Patent No.: US 6,579,840 B1
(45) Date of Patent: Jun. 17, 2003

(54) DETERGENT COMPOSITIONS OR COMPONENTS COMPRISING HYDROPHOBICALLY MODIFIED CELLULOSIC POLYMERS

(75) Inventor: Gabor Heltovics, Kenton (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/807,389

(22) PCT Filed: Oct. 6, 1999

(86) PCT No.: PCT/US99/23148

§ 371 (c)(1),
(2), (4) Date: Apr. 12, 2001

(87) PCT Pub. No.: WO00/22075

PCT Pub. Date: Apr. 20, 2000

Related U.S. Application Data

(60) Provisional application No. 60/148,053, filed on Aug. 10, 1999, and provisional application No. 60/103,978, filed on Oct. 13, 1998.

(30) Foreign Application Priority Data

Mar. 11, 1999 (GB) ..... 9905475

(51) Int. Cl.[7] ..... C11D 1/62; C11D 3/22

(52) U.S. Cl. ..... 510/327; 510/276; 510/287; 510/308; 510/322; 510/329; 510/443; 510/444; 510/445; 510/470; 510/471; 510/473; 510/474

(58) Field of Search ..... 510/276, 287, 510/308, 322, 327, 329, 470, 471, 473, 474, 443, 444, 445

(56) References Cited

U.S. PATENT DOCUMENTS

| | | | | |
|---|---|---|---|---|
| 4,540,499 A | | 9/1985 | Sakatani et al. | |
| 4,954,270 A | * | 9/1990 | Butterworth et al. | 252/8.8 |
| 5,288,484 A | | 2/1994 | Tashjian | |
| 5,308,513 A | * | 5/1994 | Harmalker et al. | 252/8.8 |
| 5,753,216 A | * | 5/1998 | Leitch et al. | 424/71 |

FOREIGN PATENT DOCUMENTS

| | | | |
|---|---|---|---|
| EP | 0 320 296 A2 | | 6/1989 |
| WO | WO 96/17916 | | 6/1996 |
| WO | 96/17917 | * | 6/1996 |
| WO | WO 98/29528 | | 7/1998 |
| WO | WO 99/14295 | | 3/1999 |

* cited by examiner

*Primary Examiner*—Charles Boyer
(74) *Attorney, Agent, or Firm*—Marianne Dressman; Julia A. Glazer; Kim William Zerby

(57) ABSTRACT

The present invention relates to detergent compositions or components comprising certain cyclic amine based polymers and certain anionic cellulose materials. This combination imparts improved appearance and integrity benefits to fabrics and textiles laundered in washing solutions formed from such compositions, whilst also providing improved whiteness and/or brightness maintenance.

9 Claims, No Drawings

DETERGENT COMPOSITIONS OR COMPONENTS COMPRISING HYDROPHOBICALLY MODIFIED CELLULOSIC POLYMERS

This application claims the benefit of provisional application No. 60/103,978 filed Oct. 13, 1998 and 60/148,053 filed Aug. 10, 1999.

TECHNICAL FIELD

The present invention relates to detergent compositions or components comprising a specific hydrophobically modified cellulosic polymer and one or more quatemary ammonium compounds.

BACKGROUND OF THE INVENTION

It is known that fabrics and textiles simply wear out over time and with use. Also, the laundering of the fabrics and textiles, over many cycles, can accentuate and contribute to the deterioration of the integrity and the appearance of such fabrics and textiles. Deterioration of fabric integrity and appearance can manifest itself in several ways. For example, short fibers are dislodged from woven and knit fabric/textile structures by the at mechanical action of laundering. These dislodged fibers may form lint, fuzz or "pills" which are visible on the surface of fabrics and diminish the appearance of newness of the fabric. Further, repeated laundering of fabrics and textiles, especially with bleach-containing laundry products, can remove dye from fabrics and textiles and impart a faded, worn out appearance as a result of diminished color intensity, and in many cases, as a result of changes in hues or shades of color.

Given the foregoing, there is clearly an ongoing need to identify materials which could be added to laundry detergent products that would associate themselves with the fibers of the fabrics and textiles laundered using such detergent products and thereby reduce or minimize the tendency of the laundered fabric/textiles to deteriorate in appearance. Any such detergent product additive material should, of course, be able to benefit fabric appearance and integrity without unduly interfering with the ability of the laundry detergent to perform its fabric cleaning function. Co-pending applications PCT/US98/19139 describes the use of hydrophobically modified cellulosic polymers which are found to provide excellent integrity benefits to fabrics.

The inventor has now found that when these hydrophobically modified cellulosic polymers are used in combination specific cationically charged compounds, namely having a quaternary ammonium group, such as specific quaternary ammonium surfactants, softeners and dispersants, the fabric care and fabric integrity can be further improved. Furthermore, the performance of the quaternary ammonium compound is improved, e.g. an surprisingly improved cleaning and/or softening and/or soil removal or whiteness or brightness maintenance is achieved when these materials are used together. It is also found that when the cellulosic material and the quatemary ammonium compound or compounds are present in an intimate mixture, such as in the form of an agglomerate, a compacted granule or a spray dried granule, these benefits are even more apparent.

It is believed that these benefits are achieved because the specific cellulosic material and the specific cationic compounds having a quatemary ammonium group, interact in such a manner that both materials enhance each others surface activity, resulting in a better interaction with or deposition onto the surface of the fabric. This then will result in improved performance of not only the cellulosic polymer, but also the quaternary ammonium compound, thus, an improved fabric integrity and improved cleaning, softening and/or soil removal or whiteness/brightness maintenance results. It is believed that when the cellulosic polymers and quaternary ammonium compound or compounds are present in an intimate mixture, e.g. in the same component or granule, this interaction between the materials is even more likely to occur or even stronger, resulting in even greater benefits

SUMMARY OF THE INVENTION

The present invention relates to a detergent composition or component, or additive comprising:

a) from 0.01% to 90% by weight, preferably form 0.05% to 50% by weight, of a salt of a quaternary ammonium compound; and b) from 0.01% to 90% by weight, preferably from about 0.05% to about 20% by weight of a hydrophobically modified cellulosic polymer.

The compositions may be laundry detergents or additives, fabric softeners or fabric treatment products. The components can be contained in these compositions. The present invention also relates to the laundering or treating of fabrics and textiles in aqueous washing or treating solutions formed from effective amounts of the detergent compositions or components described herein, or formed from the individual polymeric materials of such compositions or components. Laundering of fabrics and textiles in such washing solutions imparts fabric appearance benefits to the fabric and textile articles so treated. Such benefits can include improved overall appearance, pill/fuzz reduction, antifading, improved abrasion resistance, and/or enhanced softness and also improved whiteness and/or brightness maintenance or even improved cleaning performance.

The cationic compounds and the cellulose material are preferably in an intimate mixture with one another. In one preferred embodiment, the compounds are intimately mixed prior to introduction to the composition or component of the invention.

Preferably, the mixture is present in an agglomerated, compacted or spray-dried particle, when the composition or component is solid.

Hereby it may be preferred that the compounds are mixed with an anionic surfactant, preferably LAS, as described herein after. It may also be preferred that a hydrotrope is admixed to this mixture, preferably STS. Also preferred in the mixture are inorganic and/or organic salts and acids and/or silicates or aluminosilicates, including zeolite, amorphous silicates, crystalline (layered) silicates, carbonate, bicarbonate, phosphate, citric acid, malic acid, maleic acid, tartaric acid or salts thereof, or mixtures of these ingredients.

DETAILED DESCRIPTION OF THE INVENTION

Hydrophobically Modified Cellulosic Based Polymers

The hydrophobically modified cellulosic polymers herein include polymers, oligomers, copolymers and also cross-linked polymers, oligomers and copolymers. The will herein be referred to as cellulosic based polymers. As will be apparent to those skilled in the art, an oligomer is a molecule consisting of only a few monomer units while polymers comprise considerably more monomer units. For the present invention, oligomers are defined as molecules having an average molecular weight below about 1,000 and polymers are molecules having an average molecular weight of greater than about 1,000. One suitable type of cellulosic based polymer herein has an average molecular weight of from about 5,000 to about 2,000,000, preferably from about 50,000 to about 1,000,000.

Depending on the application of the composition or component herein, the amount of cellulosic based polymers in the compositions or components may very. The cellulosic based polymers will generally be about 0.01% to about 90% by the weight of the detergent composition or component, more preferably from 0.05% to 20% or even from 0.05% to 15% by weight. In detergent compositions herein it may for example be preferred that the polymer is present at a level of from 0.05% to 10% by weight of the detergent composition, preferably from 0.05% to 5% or even from 0.05% to 3% or even 0.1% to 2% by weight. In detergent additives or components, the polymer may preferably be present at a level of 0.05% to 40% by weight of the component, or even from 0.05% to 20% or even 0.1% to 15% or even 1% to 10% by weight.

The cellulosic based polymers herein is preferably present in the composition or component in such an amount that the concentration of polymer in the wash is from 100 ppm to 10,000 ppm, preferably from 500 ppm to 7000 ppm or even from 1000 to about 3000 ppm.

The cellulosic based polymer for use herein is preferably of the following formula:

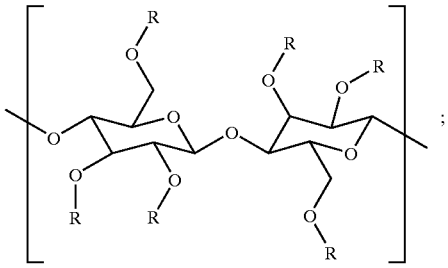

wherein each R is selected from the group consisting of $R_2$, $R_C$, and

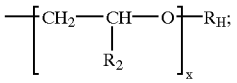

wherein:

each $R_2$ is independently selected from the group consisting of H and $C_1$–$C_4$ alkyl;

each $R_C$ is

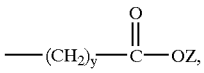

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2$N-alkyl, $(R_4)_2$N-2-hydroxyalkyl, $(R_4)$3N-alkyl, $(R_4)_3$N-2-hydroxyalkyl, $C_6$–$C_{12}$ aryloxy-2-hydroxyalkyl,

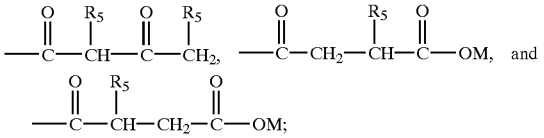

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminoalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $(R_4)_2$N-alkyl, and $(R_4)_3$N-alkyl;

wherein:

M is a suitable cation selected from the group consisting of Na, K, 1/2Ca, and 1/2Mg;

each x is from 0 to about 5;

each y is from about 1 to about 5; and provided that:

the Degree of Substitution for group $R_H$ is between about 0.001 and 0.1, more preferably between about 0.005 and 0.05, and most preferably between about 0.01 and 0.05;

the Degree of Substitution for group $R_C$ wherein Z is H or M is between about 0.2 and 2.0, more preferably between about 0.3 and 1.0, and most preferably between about 0.4 and 0.7;

if any $R_H$ bears a positive charge, it is balanced by a suitable anion; and two $R_4$'s on the same nitrogen can together form a ring structure selected from the group consisting of piperidine and morpholine.

The "Degree of Substitution" for group $R_H$, which is sometimes abbreviated herein "$DS_{RH}$", means the number of moles of group $R_H$ components that are substituted per anhydrous glucose unit, wherein an anhydrous glucose unit is a six membered ring as shown in the repeating unit of the general structure above.

The "Degree of Substitution" for group $R_C$, which is sometimes abbreviated herein "$DS_{RC}$", means the number of moles of group $R_C$ components, wherein Z is H or M, that are substituted per anhydrous glucose unit, wherein an anhydrous glucose unit is a six membered ring as shown in the repeating unit of the general structure above. The requirement that Z be H or M is necessary to insure that there are a sufficient number of carboxy methyl groups such that the resulting polymer is soluble. It is understood that in addition to the required number of $R_C$ components wherein Z is H or M, there can be, and most preferably are, additional $R_C$ components wherein Z is a group other than H or M.

These polymers can for example be obtained by use of processes as described in co-pending application PCT/US98/19139 and PCT/US98/19142.

Quaternary Ammonium Compounds

The compositions or components of the invention comprise a quaternary ammonium compound. This compound is preferably selected from quaternary ammonium surfactants, quaternary ammonium softeners, quaternary ammonium dispersants, described herein after. Highly preferred are the quatemary ammonium surfactants.

The levels of the quaternary ammonium surfactants used in detergent compositions of the invention are preferably from 0.1% to 20%, preferably from 0.4% to 7%, most preferably from 0.5% to about 5.0%, by weight of the detergent composition. The levels of the quaternary ammonium surfactants in components or additives of the invention are preferably from 0.1% to 90%, preferably from 0.5% to 50%, most preferably from 2% to about 30%, by weight of the detergent component or additive.

The levels of the quaternary ammonium softeners used in detergent compositions of the invention are preferably from 0.1% to 20%, preferably from 0.4% to 15%, most preferably from 0.5% to about 10%, by weight of the detergent composition. The levels of the quaternary ammonium surfactants in components or additive of the invention are preferably from 0.1% to 90%, preferably from 0.5% to 50%, most preferably from 2% to about 30%, by weight of the detergent component or additive.

The levels of the quaternary ammonium dispersant used in detergent compositions of the invention are preferably from 0.05% to 10%, preferably from 0.1% to 7%, most preferably from 0.5% to about 5.0%, by weight of the detergent composition. The levels of the quatemary ammonium surfactants in components or additive of the invention are preferably from 0.1% to 60%, preferably from 0.5% to 40%, most preferably from 0.5% to about 25%, by weight of the detergent component or additive.

Ouaternary Ammonium Surfactants

Preferably, the cationic surfactant herein is selected from the group consisting of cationic mono-alkoxylated amine surfactants (not being the sodium salt of the cationic $C_{12}$–$C_{14}$ alkyl dimethyl ammonium ethanol surfactant), cationic bis-alkoxylated amine surfactants and mixtures thereof. Also preferred are salts of the cationic $C_{12}$–$C_{14}$ alkyl dimethyl ammonium ethanol surfactant.

Cationic Mono-alkoxylated Amine Surfactants

The cationic surfactant herein can be a cationic mono-alkoxylated amine surfactant, which has the general formula I:

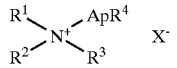

(I)

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8.

Preferably the $ApR^4$ group in formula I has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are $—CH_2CH_2OH$, $—CH_2CH_2CH_2OH$, $—CH_2CH(CH_3)OH$ and $—CH(CH_3)CH_2OH$, with $—CH_2CH_2OH$ being particularly preferred.

Preferred $R^1$ groups are linear alkyl groups. Linear $R^1$ groups having from 8 to 22 carbon atoms, or from 9 to 16 carbon atoms are preferred. Such a cationic surfactant which is highly preferred has a formula wherein $R^1$ is a $C_8$–$C_{10}$ or a $C_{12}$–$C_{14}$ alkyl group, p is 1, A is ethoxy and $R_2$ and $R_3$ are methyl groups.

It has been found that mixtures of the cationic surfactants of formula I may be particularly effective, for example, surfactant mixtures in which $R^1$ may be a combination of $C_8$ and $C_{10}$ linear alkyl groups, $C_9$ and $C_{11}$ alkyl groups, $C_{12}$ and $C_{14}$ alkyl groups.

Another highly preferred cationic mono-alkoxylated amine surfactants for use herein are of the formula

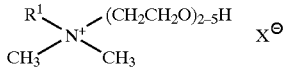

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

When used in granular detergent compositions cationic mono-alkoxylated amine surfactants wherein the hydrocarbyl substituent $R^1$ is $C_8$–$C_{14}$ can be preferred, because they enhance the rate of dissolution of laundry granules, especially under cold water conditions, as compared with the higher chain length materials.

Cationic Bis-alkoxvlated Amine Surfactant

The cationic surfactant herein can be a cationic bis-alkoxylated amine surfactant, which has the general formula II:

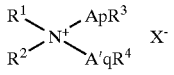

(II)

wherein $R^1$ is an alkyl or alkenyl moiety containing from about 8 to about 18 carbon atoms, preferably 10 to about 16 carbon atoms, most preferably from about 10 to about 14 carbon atoms; $R_2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are at each selected from $C_1$–$C_4$ alkoxy, especially ethoxy, (i.e., $—CH_2CH_2O—$), propoxy, butoxy and mixtures thereof; p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

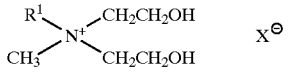

wherein $R^1$ is $C_{10}$–$C_{18}$ hydrocarbyl and mixtures thereof, preferably $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

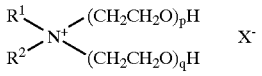

wherein $R^1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

When used in granular detergent compositions in accord with the invention, cationic bis alkoxylated amine surfactants wherein the hydrocarbyl substituent $R^1$ is $C_8$–$C_{14}$, can be preferred cationic surfactants, because they enhance the rate of dissolution of laundry granules, especially under cold water conditions, as compared with the higher chain length materials.

A cationic surfactant according to the present invention comprises at least one quatemized ammonium group and at least one primary, secondary or tertiary amine group, whereby not more than one linear or branched polyoxyalkylene group is present as substituent group.

Ouaternary Polyamine Surfactant

Examples of preferred qaternary polyamine surfactants for use herein are:

(II)

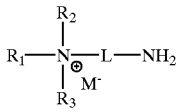

(III)

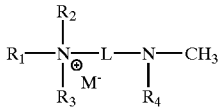

(IV)

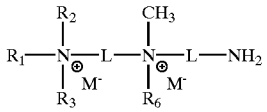

(V)

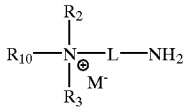

(VI)

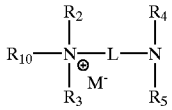

-continued (VII)

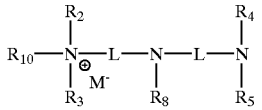

wherein $R_1$, $R_4$, $R_6$ and $R_8$ are as described above; $R_2$, $R_3$ and $R_5$ are independently selected from the group consisting of methyl, ethyl, hydroxyethyl, hydroxypropyl, polyhydroxy propyl, ethoxy, propoxy or 2,3,4,5,6-penta hydroxy hexyl, and are most preferably methyl or hydroxyethyl groups; $R_{10}$ is a methyl or hydroxyethyl group; L is as described above; $R_1$ and/or $R_2$ and/or $R_4$ are most preferably a 2-ethylhexyl group.

A highly preferred cationic polyamine surfactant is of formula VI, as defined above, wherein $R_2$ is a hydroxypropyl or hydroxyethyl group, $R_3$ and $R_{10}$ are methyl groups, L is $C_2$–$C_3$ alkyl group.

Highly preferred polyamine cationic surfactant are those of the formulas:

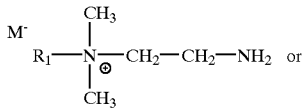

or

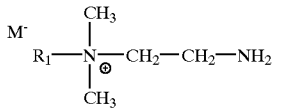

or wherein $R_1$ is as described above, preferably a $C_2$–$C_{14}$, preferably $C_6$–$C_{14}$ linear or branched alkyl, (poly) hydroxy alkyl, alkoxy or aralkyl group; particularly preferred $R_1$ groups are hydroxyalkyl groups, where the alkyl groups have 2 to 5 carbon atoms, especially hydroxyethyl and hydroxypropyl are preferred; particularly preferred alkyl $R_1$ groups have up to 9 carbon atoms, most preferably $R_1$ is a 2-ethylhexyl group; and $R_{11}$ is a $C_2$–$C_{14}$ alkyl, (poly) hydroxy alkyl, alkoxy or aralkyl group.

The anion $M^-$ is a counterion for the cationically charged polyamine surfactant, preferably bromide or more preferably chloride.

Ouaternary Ammonium Dispersant

The dispersant for use herein can be any of the compounds as described in EP-B-011965 and U.S. Pat. No. 4,659,802 and U.S. Pat. No. 4,664,848.

Preferred quaternary ammonium dispersants are monoamines and diamines of the formula:

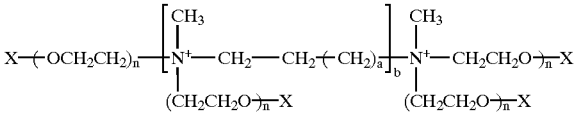

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene), b is 1 or 0; for cationic monoamines (b=0), n is at least 16, with a typical range of from 20 to 35; highly preferred are diamines (b=1), whereby n is at least about 12 with a typical range of from about 12 to about 42, and a is preferably 4.

Ouaternary Softener Compounds

The quaternary softener compounds herein are preferably quatemary ammonium compounds having one or two C12–C24 alkyl or alkenyl chains, optionally substituted with one or more functional groups such as —OH, —O—, CONH, —COO—, and with two or three C1–C11, preferably C–C6 or even C1 to C4 alkyl or alkenyl groups, optionally substituted with a functional groups such as —OH, —O—, CONH, —COO— or mixtures thereof.

Preferably, they are di-long-chain amides as disclosed in EP-B-0 242919. Preferably, when comprising two C12–C24 groups, they comprise two C1–C4 groups, preferably methyl or ethyl groups.

When the softeners comprise three C1–C11 alkyl or alkenyl groups, they preferably comprise an C18–C24 alkyl or akenyl group.

The anion is preferably chloride or bromide.

Other preferred cationic softeners are for example described in U.S. Pat. No. 5,540,850.

Detergent Compositions or Components

The compositions or components of the invention are preferably laundry, compositions, preferably in the form of granules, extrudates, flakes or tablets, liquids or pastes.

The compositions or components in accord with the invention may also contain additional detergent components. The precise nature of these additional components, and levels of incorporation thereof will depend on the physical form of the composition or component, and the precise nature of the washing operation for which it is to be used.

They preferably contain one or more additional detergent components selected from surfactants, bleaches, bleach catalysts, alkalinity systems, builders, phosphate-containing builders, organic polymeric compounds, enzymes, suds suppressors, lime soap, dispersants, soil suspension and anti-redeposition agents soil releasing agents, perfumes, brightners, photobleaching agents and additional corrosion inhibitors.

Preferred additional ingredients are cyclic amine based polymers as described in co-pending application PCT/US98/19143 and PCT/US98/19141, in particular those compounds described therein in the examples, in particular example 1 and 2. These polymers may be present at a level of from 0.01% to 10% by weight of the composition, more preferably at a level of from 0.05% to 5% by weight or even form 0.1% to 2% by weight of the composition, or at a level of from 0.05% to 30% by weight of the component, more preferably at a level of from 0.1% to 20% by weight or even form 0.3% to 10% by weight of the component.

Surfactant

The components or compositions in accord with the invention preferably contain one or more surfactants selected from anionic, nonionic, cationic, ampholytic, amphoteric and zwittenronic surfactants and mixtures thereof.

A typical listing of anionic, nonionic, ampholytic, and zwitterionic classes, and species of these surfactants, is given in U.S. Pat. No. 3,929,678 issued to Laughlin and Heurinrg on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitteronic surfactants are generally used in combination with one or more anionic and/or nonionic surfactants.

Anionic Surfactant

The components or compositions in accord with the present invention preferably comprise an additional anionic surfactant. Essentially any anionic surfactants useful for detersive purposes can be comprised in the detergent components or compositions. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate and sulfonate surfactants are preferred.

Highly preferred are surfactants systems comprising a sulfonate and a sulfate surfactant, preferably a linear or branched alkyl benzene sulfonate and alkyl ethoxylsulfates, as described herein, preferably combined with a cationic surfactants as described herein.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N-($C_1$–$C_4$ alkyl) and —N—($C_1$–$C_2$ hydroxyalkyl) glucamine sulfates; and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$—$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and/or sulfonate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of $C_5$–$C_{20}$ linear alklylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_x CH_2COO^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula $RO—(CHR_1—CHR_2—O)—R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Certain soaps may also be included as suds suppressers.

Alkali Metal Sarcosinate Surfactant

Other suitable anionic surfactants are the alkali metal sarcosinates of formula $R—CON(R_1)CH_2COOM$, wherein R is a $C_5$–$C_{17}$ linear or branched alkyl or alkenyl group, $R_1$ is a $C_1$–$C_4$ alkyl group and M is an alkali metal ion. Preferred examples are the myristyl and oleoyl methyl sarcosinates in the form of their sodium salts.

Alkoxylated Nonionic Surfactant

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction;.more preferably Z is a glycityl.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and $—(C_2H_4O)_xH$, where x is in the range of from 1 to 3.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10-18}$ acylamido alkyl dimethylamine oxide.

A suitable example of an alkyl aphodicarboxylic acid is Miranol(TM) C2M Conc. manufactured by Miranol, Inc., Dayton, N.J.

Zwitterionic Surfactant

Zwitterionic surfactants can also be incorporated into the detergent components or compositionss in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO$— wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Perhydrate Bleaches

An preferred additional components of the components or compositions is a perhydrate bleach, such as metal perborates, metal percarbonates, particularly the sodium salts. Perborate can be mono or tetra hydrated. Sodium percarbonate has the formula corresponding to $2Na_2CO_3.3H_2O_2$, and is available commercially as a crystalline solid.

Potassium peroxymonopersulfate, sodium per is another optional inorganic perhydrate salt of use in the detergent components or compositions herein.

Organic Peroxyacid Bleaching System

A preferred feature of the components or compositions is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches, such as the perborate bleach of the claimed invention. In an alternative preferred execution a preformed organic peroxyacid is incorporated directly into the components or compositions. Components or compositions containing mixtures of a hydrogen peroxide source and organic peroxyacid precursor in combination with a preformed organic peroxyacid are also envisaged.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

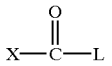

where L is a leaving group and X is essentially any functionality, such that on perhydroloysis the structure of the peroxyacid produced is

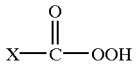

Peroxyacid bleach precursor compounds are preferably incorporated at a level of from 0.5% to 20% by weight, more preferably from 1% to 15% by weight, most preferably from 1.5% to 10% by weight of the detergent compositions.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching components or compositions.

Preferred L groups are selected from the group consisting of:

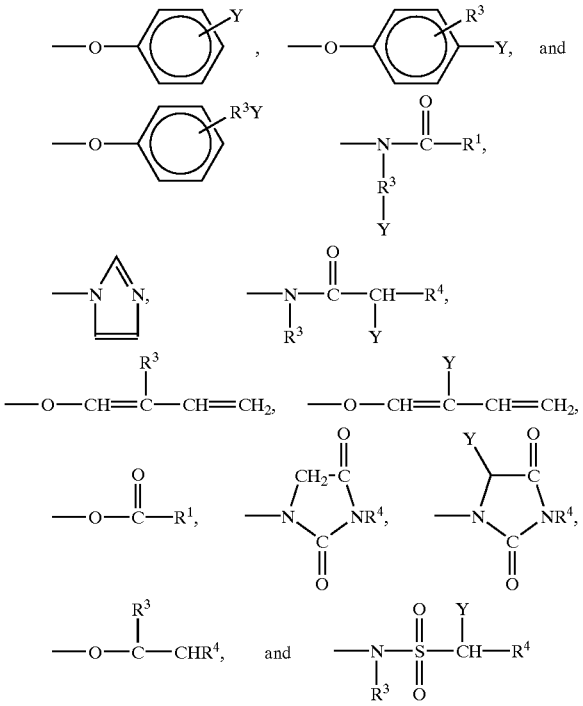

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^{31}\ M^+$, $—CO_2^-M^+$, $—SO_4^-M^+$, $—N^+(R^3)_4X^-$ and $O{\leftarrow}N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N-,N,$N^1N^1$ tetra acetylated alkylene diamines wherein the alkylerie group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Alkyl Peroxyacid Precursors

Amide substituted alkyl peroxyacid precursor compounds are suitable herein, including those of the following general formulae:

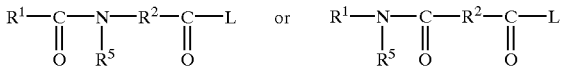

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

Preformed Organic Peroxyacid

The detergent composition may contain, in addition to, or as an alternative to, an organic peroxyacid bleach precursor compound, a preformed organic peroxyacid, typically at a level of from 1% to 15% by weight, more preferably from 1% to 10% by weight of the composition.

A preferred class of organic peroxyacid compounds are the amide substituted compounds of the following general formulae:

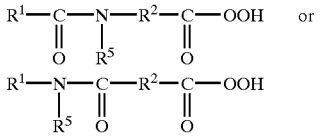

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Water-Soluble Builder Compound

The components or compositions in accord with the present invention preferably contain a water-soluble builder compound, typically present in detergent compositions at a level of from 1% to 80% by weight, preferably from 10% to 60% by weight, most preferably from 15% to 40% by weight of the composition.

The detergent components or compositions of the invention preferably comprise phosphate-containing builder material. Preferably present at a level of from 0.5% to 60%, more preferably from 5% to 50%, more preferably from 8% to 40.

The phosphate-containing builder material preferably comprises tetrasodium pyrophosphate or even more preferably anhydrous sodium tripolyphosphate.

Suitable water-soluble builder compounds include the water soluble monomeric polycarboxylates, or their acid forms, homo or copolymeric polycarboxylic acidsor their salts in which the polycarboxylic acid comprises at least two carboxylic radicals separated from each other by not more that two carbon atoms, borates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight of the composition.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The components or compositions in accord with the present invention may contain a partially soluble or insoluble builder compound, typically present in detergent compositions at a level of from 0.5% to 60% by weight, preferably from 5% to 50% by weight, most preferably from 8% to 40% weight of the composition.

Examples of largely water insoluble builders include the sodium aluminosilicates.

Suitable aluminosilicate zeolites have the unit cell formula $Na_z[(AlO_2)_z(SiO_2)y]$. $xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}].\ xH_2O$$

wherein x is from 20 to 30, especially 27. Zeolite X has the formula $Na_{86}$ $[(AlO_2)_{86}(SiO_2)_{106}]$. 276 $H_2O$.

Another preferred aluminosilicate zeolite is zeolite MAP builder. The zeolite MAP can be present at a level of from 1% to 80%, more preferably from 15% to 40% by weight of the compositions.

Zeolite MAP is described in EP 384070A (Unilever). It is defined as an alkali metal alumino-silicate of the zeolite P type having a silicon to aluminum ratio not greater than 1.33, preferably within the range from 0.9 to 1.33 and more preferably within the range of from 0.9 to 1.2.

Of particular interest is zeolite MAP having a silicon to aluminum ratio not greater than 1.15 and, more particularly, not greater than 1.07.

In a preferred aspect the zeolite MAP detergent builder has a particle size, expressed as a $d_{50}$ value of from 1.0 to 10.0 micrometres, more preferably from 2.0 to 7.0 micrometres, most preferably from 2.5 to 5.0 micrometres.

The $d_{50}$ value indicates that 50% by weight of the particles have a diameter smaller than that figure. The particle size may, in particular be determined by conventional analytical techniques such as microscopic determination using a scanning electron microscope or bymeans of a laser granulometer. Other methods of establishing $d_{50}$ values are disclosed in EP 384070A.

Heavy Metal Ion Sequestrant

The components or compositions of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions or component Suitable heavy metal ion sequestrants for use herein include organic phosphonates, such as the amino alkylene poly (alkylene phosphonates), alkali metal ethane 1-hydrbxy disphosphonates andnitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediarnine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are also suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof.

Enzyme

Another preferred ingredient useful in the components or compositions herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent components or compositionss. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the-tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, c-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymesmaybe those described in PCT/US 9703635, and in WO95/26397 and WO96/23873.

Amylase enzyme may be incorporated into the composition in accordance with the invention at a level of from 0.0001% to 2% active enzyme by weight of the composition.

Lipolytic enzyme may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example, from a lipase producing strain of Humicola sp., Thermomyces sp. or Pseudomonas sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Asperpillus orvza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Organic Polymeric Compound

Organic polymeric compounds are preferred additional components of the components or compositions herein and are preferably present as components of any particulate components where they may act such as to bind the particulate component together. By organic polymeric compound it is meant herein essentially any polymeric organic compound commonly used as dispersants, and anti-redeposition and soil suspension agents in detergent components or compositionss, including any of the high molecular weight organic polymeric compounds described as clay flocculating agents herein, including quaternised ethoxylated (poly) amine clay-soil removal anti-redeposition agent in accord with the invention.

Organic polymeric compound is typically incorporated in the detergent compositions of the invention at a level of from 0.01% to 30%, preferably from 0.1% to 15%, most preferably from 0.5% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent components or compositionss herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Highly preferred polymeric components herein are cotton and non-cotton soil release polymer according to U.S. Pat. No. 4,968,451, Scheibel et al., and U.S. Pat. No. 5,415,807, Gosselink et al., and in particular according to U.S. application Ser. No. 60/051517.

Suds Suppressing System

The detergent compositions of the invention, when, formulated for use in machine washing compositions, may comprise a suds suppressing system present at a level of from 0.01% to 15%, preferably from 0.02% to 10%, most preferably from 0.05% to 3% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable anti foam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination
   (i) polydimethyl siloxane, at a level of from 50% to 99%, preferably 75% to 95% by weight of the silicone antifoam compound; and
   (ii) silica, at a level of from 1% to 50%, preferably 5% to 25% by weight of the silicone/silica antifoam compound;

wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Coming under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Polymeric Dye Transfer Inhibiting Apents

The compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Optical Brightener

The compositions herein also optionally contain from about 0.005% to 5% by weight of certain types of hydrophilic optical brighteners.

Hydrophilic optical brighteners useful herein include those having the structural formula:

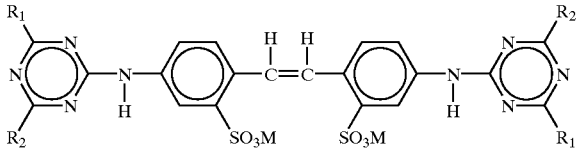

wherein $R_1$ is selected from anilino, N-2-bis-hydroxyethyl and NH-2-hydroxyethyl; $R_2$, is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4'-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-CBS-X and Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino)]2,2'-stilbenedisulfonic acid, sodium salt. This particular brightener species are commercially marketed under the tradename Tinopal-DMS-X and Tinopal AMS-GX by Ciba Geigy Corporation.

Polymeric Soil Release Agent

Additional polymeric soil release agents, hereinafter "SRA", can optionally be employed in the present compositions. If utilized, SRA's will generally comprise from 0.01% to 10.0%, typically from 0.1% to 5%, preferably from 0.2% to 3.0% by weight, of the compositions.

The additional SRP's include hydrophivally modified cellulose derivatives, such as ester derivatives of CMC. Also included are nonionic cellulose ethers and derivatives.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligoimeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM 100 and METOLOSE SM200, which are the trade names of methyl cellulose ethers manufactured by Shin-etsu Kagaku Kogyo KK.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al. Other classes include: (III) anionic terephthalate-based SRA's of the urethane-linked variety, see U.S. Pat. No. 4,201,824, Violland et al.;

Other Optional Ingredients

Other optional ingredients suitable for inclusion in the components or compositionss of the invention include perfumes, colours and filler salts, with sodium sulfate being a preferred filler salt.

Highly preferred compositions contain from about 2% to about 10% by weight of an organic acid, preferably citric acid. Also, preferably combined with a carbonate salt, minor amounts (e.g., less than about 20% by weight) of neutralizing agents, buffering agents, phase regulants, hydrotropes, enzyme stabilizing agents, polyacids, suds regulants, opacifiers, anti-oxidants,.bactericides and dyes, such as those described in U.S. Pat. No. 4,285 841 to Barrat et al., issued Aug. 25, 1981 (herein incorporated by reference), can be present.

Form of the Components or Compositionss

The components or compositions herein can take a variety of physical forms including liquid and solid forms such as tablet, flake, pastille and bar, and preferably granular forms. The components or compositions can be made via a variety of methods, depending on their product form. The solid compositions or components can be made by methods such as dry-mixing, agglomerating, compaction, or spray-drying of the various compounds comprised in the detergent component, or mixtures of these techniques.

It is highly preferred that the cyclic amine based polymers and the anionic cellulose materials herein are present in an intimate mixture. In solid compositins hor components herein, this mixture can be obtained by any mixing method, including agglomeration. The intimate mixture are preferably in the form of a compacted, agglomerated or spray dried granule.

Detergent compositions and components herein preferably have a bulk density of from 300 g/liter or even 350 g/liter or 450 g/liter to preferably 1500 g/liter or 1000 g/liter or even to 850 g/liter.

Fabric Laundering Method

The present invention also provides a method for laundering. Such a method employs contacting these fabrics with an aqueous washing solution formed from an effective amount of the detergent components or compositions herein before described or formed from the individual components of such components or compositions. Contacting of fabrics with washing solution will generally occur under conditions of agitation although the components or compositions of the present invention may also be used to form aqueous unagitated soaking solutions for fabric cleaning and treatment. As discussed above, it is preferred that the washing solution have a pH of less than about 11.0, preferably it has a pH of less than 10.5 and most preferably it has a pH of less than 9.5. An effective amount of a high density liquid or granular detergent components or compositions in the aqueous wash solution in the washing machine is preferably from about 500 to about 10000 ppm or even 7000 ppm, more preferably from about 1000 to about 3000 ppm.

Fabric Conditioning and Softening

The detergent components or compositions herein may also be used to treat and condition fabrics and textiles. Thus, for example, a fabric conditioning components or compositions comprising the cyclic amine based polymers and anionic cellulose polymers as described herein, may be added during the rinse cycle of a conventional home laundering operation in order to impart the desired fabric appearance and integrity benefits hereinbefore described. Then, preferably at least about 1%, preferably from about 10%, more preferably from about 20% to about 80%, more preferably to about 60% by weight, of the composition or component is one or more fabric softener actives, such as cationically charged hydrocarbons, such as C12–C22 dialkyl substitued quaternary ammonium salts and/or clays, optionaly with a flocculating polymer.

Alternatively, the composition or component herein may be present in or in the form of a softening and cleaning composition, such as for example described in EP-B1-313146 and WO93/01267, preferably comprising additional softening ingredients, such as clay and optionally a flocculating polymer.

Abbreviations used in the effervescence component and detergent composition examples

| | |
|---|---|
| LAS: | Sodium linear C11–13 alkyl benzene sulfonate |
| LAS (I): | Potassium linear or branched C11–13 alkyl benzene sulfonate |

-continued

| Abbreviations used in the effervescence component and detergent composition examples | |
|---|---|
| TAS: | Sodium tallow alkyl sulfate |
| CxyAS: | Sodium C1x–C1y alkyl sulfate |
| C46SAS: | Sodium C14–C16 secondary (2,3) alkyl sulfate |
| CxyEzS: | Sodium C1x–C1y alkyl sulfate condensed with z moles of ethylene oxide |
| CxyEz: | C1x–C1y predominantly linear primary alcohol condensed with an average of z moles of ethylene oxide |
| QAS: | R2.N+(CH3)2(C2H4OH) with R2 = C12–C14 alkyl |
| QAS 1: | R2.N+(CH3)2(C2H4OH) with R2 = C8–C11 alkyl |
| QASA: | R2.R3.N+(CH3)2 with R2 and R3 independently being C12–C24 alkyl |
| QASA 1: | R2.N+(R1)3 with R2 being C16–C24 alkyl and R1 being C1–C4 alkyl |
| APA: | C8–C10 amido propyl dimethyl amine |
| Soap: | Sodium linear alkyl carboxylate derived from an 80/20 mixture of tallow and coconut fatty acids |
| STS: | Sodium toluene sulphonate |
| CFAA: | C12–C14 (coco) alkyl N-methyl glucamide |
| TFAA: | C16–C18 alkyl N-methyl glucamide |
| TPKFA: | C12–C14 topped whole cut fatty acids |
| STPP: | Anhydrous sodium tripolyphosphate |
| TSPP: | Tetrasodium pyrophosphate |
| Zeolite A: | Hydrated sodium aluminosilicate of formula Na12(AlO2SiO2)12.27H2O having a primary particle size in the range from 0.1 to 10 micrometers (weight expressed on an anhydrous basis) |
| NaSKS-6: | Crystalline layered silicate of formula d-Na2Si2O5 |
| Citric acid I: | Anhydrous citric acid, 80% having a particle size of from 40 microns to 70 microns, and having a volume median particle size of 55 microns |
| Citric acid II: | Anhydrous or monohydrate citric acid, 80% having a particle size of from 15 microns to 40 microns, having a volume average particle size of 25 microns |
| Maleic acid: | Anhydrous malic acid, 80% having a particle size of from 50 microns to 100 microns, having a volume median particle size of 75 microns |
| Malic acid: | Anhydrous maleic acid |
| Tartaric acid: | Anhydrous tartaric acid |
| Carbonate: | Anhydrous sodium carbonate |
| Bicarbonate: | Anhydrous sodium bicarbonate |
| Silicate: | Amorphous sodium silicate (SiO2:Na2O = 2.0:1) |
| Sulfate: | Anhydrous sodium sulfate |
| Mg sulfate: | Anhydrous magnesium sulfate |
| Citrate: | Tri-sodium citrate dihydrate of activity 86.4% with a particle size distribution between 425 μm and 850 μm |
| MA/AA: | Copolymer of 1:4 maleic/acrylic acid, average molecular weight about 70,000 |
| MA/AA (1): | Copolymer of 4:6 maleic/acrylic acid, average molecular weight about 10,000 |
| AA: | Sodium polyacrylate polymer of average molecular weight 4,500 |
| CABP: | Cyclic amine based polymer as described in PCT/US98/19143 and PCT/US98/19141 in examples 1 and 2 in table |
| HMC 1: | Hydrophobically modified cellulose having an ester group comprising 14–18 carbon atoms |
| AC: | Hydrophobically modified amide cellulose having an amide group comprising 2 to 12 carbon atoms |
| CMC: | Sodium carboxymethyl cellulose |
| Cellulose ether: | Methyl cellulose ether with a degree of polymerization of 650 available from Shin Etsu Chemicals |
| Protease: | Proteolytic enzyme, having 3.3% by weight of active enzyme, sold by NOVO Industries A/S under the tradename Savinase |

-continued

| Abbreviations used in the effervescence component and detergent composition examples | |
|---|---|
| Protease 1: | Proteolytic enzyme, having 4% by weight of active enzyme, as described in WO 95/10591, sold by Genencor Int. Inc. |
| Alcalase: | Proteolytic enzyme, having 5.3% by weight of active enzyme, sold by NOVO Industries A/S |
| Cellulase: | Cellulytic enzyme, having 0.23% by weight of active enzyme, sold by NOVO Industries A/S under the tradename Carezyme |
| Amylase: | Amylolytic enzyme, having 1.6% by weight of active enzyme, sold by NOVO Industries A/S under the tradename Termamyl 120T |
| Lipase: | Lipolytic enzyme, having 2.0% by weight of active enzyme, sold by NOVO Industries A/S under the tradename Lipolase |
| Lipase (1): | Lipolytic enzyme, having 2.0% by weight of active enzyme, sold by NOVO Industries A/S under the tradename Lipolase Ultra |
| Endolase: | Endoglucanase enzyme, having 1.5% by weight of active enzyme, sold by NOVO Industries A/S |
| PB4: | Particle containing sodium perborate tetrahydrate of nominal formula NaBO2.3H2O |
| PB1: | Particle containing anhydrous sodium perborate bleach of nominal formula NaBO2.H2O2 |
| Percarbonate: | Particle containing sodium percarbonate of nominal formula 2Na2CO3.3H2O2 |
| NOBS: | Particle comprising nonanoyloxybenzene sulfonate in the form of the sodium salt, the particles having a weight average particle size of 750 microns to 900 microns |
| NAC-OBS: | Particle comprising (6-nonamidocaproyl) oxybenzene sulfonate, the particles having a weight average particle size of from 825 microns to 875 microns |
| TAED: | Tetraacetylethylenediamine |
| DTPA: | Diethylene triamine pentaacetic acid |
| DTPMP: | Diethylene triamine penta(methylene phosphonate), marketed by Monsanto under the Tradename Dequest 2060 |
| Photoactivated: | Sulfonated zinc phthlocyanine encapsulated in bleach (1) dextrin soluble polymer |
| Photoactivated: | Sulfonated alumino phthlocyanine encapsulated in bleach (2) dextrin soluble polymer |
| Brightener 1: | Disodium 4,4'-bis(2-sulphostyryl)biphenyl |
| Brightener 2: | Disodium 4,4'-bis(4-anilino-6-morpholino-1,3,5-triazin-2-yl)amino)stilbene-2:2'-disulfonate |
| EDDS: | Ethylenediamine-N,N'-disuccinic acid, (S, S) isomer in the form of its sodium salt. |
| HEDP: | 1,1-hydroxyethane diphosphonic acid |
| PEGx: | Polyethylene glycol, with a molecular weight of x (typically 4,000) |
| PEO: | Polyethylene oxide, with an average molecular weight of 50,000 |
| TEPAE: | Tetraethylenepentaamine ethoxylate |
| PVI: | Polyvinyl imidosole, with an average molecular weight of 20,000 |
| PVP: | Polyvinylpyrolidone polymer, with an average molecular weight of 60,000 |
| PVNO: | Polyvinylpyridine N-oxide polymer, with an average molecular weight of 50,000 |
| PVPVI: | Copolymer of polyvinylpyrolidone and vinylimidazole, with an average molecular weight of 20,000 |
| QEA: | bis((C2H5O)(C2H4O)n)(CH3)-N+-C6H12-N+-(CH3) bis((C2H5O)—(C2H4O))n, wherein n = from 20 to 30 |
| SRP: | Anionically end capped poly esters |
| PEI: | Polyethyleneimine with an average molecular weight of 1800 and an average ethoxylation degree of 7 ethyleneoxy residues per nitrogen |

-continued

| Abbreviations used in the effervescence component and detergent composition examples | |
|---|---|
| Silicone antifoam: | Polydimethylsiloxane foam controller with siloxane-oxyalkylene copolymer as dispersing agent with a ratio of said foam controller to said dispersing agent of 10:1 to 100:1 |
| Opacifier: | Water based monostyrene latex mixture, sold by BASF Akiengesellschaft under the trade-name Lytron 621 |
| Wax: | Paraffin wax |

Effervescence granule: any of the effervescence granules I to XII

The following effervescence granules I to XII are in accord with the invention (ingredients in % by weight of effervescence granule). The granules can be prepared by mixing the ingredeints and agglomerating the ingredients or by compacting the mixed ingredients, the later being the preffered process for preparing particle I, IV and VIII.

In the following examples all levels are quoted as % by weight of the composition:

TABLE I

The following compositions are in accordance with the invention.

| | A | B | C | D | E | F | G | H | I |
|---|---|---|---|---|---|---|---|---|---|
| Spray-dried Granules | | | | | | | | | |
| LAS | 10.0 | 10.0 | 15.0 | 5.0 | 5.0 | 10.0 | — | — | — |
| TAS | — | 1.0 | — | | | | — | — | — |
| MBAS | — | — | | 5.0 | 5.0 | | — | — | — |
| $C_{45}AS$ | — | — | 1.0 | | 2.0 | 2.0 | — | — | — |
| $C_{45}AE_3S$ | — | — | | 1.0 | | | — | — | — |
| QAS or QAS 1 | 1.0 | 1.5 | 1.0 | 1.0 | 0.5 | 0.8 | 0.8 | 1.2 | 2.0 |
| HMC | 0.3 | 0.8 | 1.5 | 1.0 | 0.9 | 1.3 | 0.5 | 1.5 | 4.0 |
| MgSO4 | 0.5 | 0.5 | 0.1 | — | | | — | — | — |
| Sodium citrate | — | — | — | 3.0 | 5.0 | | — | — | — |
| Sodium carbonate | 10.0 | 7.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | 16.0 | 18.0 | 20.0 | 20.0 | — | — | — | — | — |
| SKS-6 | — | — | — | 3.0 | 5.0 | — | — | — | — |
| MA/AA or AA | 1.0 | 2.0 | 11.0 | — | — | 2.0 | — | — | — |
| PEG 4000 | — | 2.0 | — | 1.0 | — | 1.0 | — | — | — |
| QEA | 1.0 | — | — | — | 1.0 | — | 0.5 | — | |
| Brightener | 0.05 | 0.05 | 0.05 | — | 0.05 | — | — | — | — |
| Silicone oil | 0.01 | 0.01 | 0.01 | — | — | 0.01 | — | — | — |
| Agglomerate | | | | | | | | | |
| LAS | | | — | — | — | — | 2.0 | 2.0 | — |
| MBAS | | | — | — | — | — | — | — | 1.0 |
| $C_{45}AS$ | | | — | — | — | — | 2.0 | — | — |
| $AE_3$ | | | — | — | — | — | — | 1.0 | 0.5 |
| Carbonate | | | — | — | 4.0 | 1.0 | 1.0 | 1.0 | — |
| Sodium citrate | | | — | — | — | — | — | — | 5.0 |
| CFAA | | | | | — | — | — | — | — |
| Citric acid | | | — | — | — | 4.0 | — | 1.0 | 1.0 |
| QEA | | | — | — | — | 2.0 | 2.0 | — | — |
| SRP | | | — | — | — | 1.0 | 1.0 | 0.2 | — |
| Zeolite A | | | — | — | — | 15.0 | 26.0 | 15.0 | 16.0 |
| Sodium silicate | | | — | — | — | — | — | — | — |
| PEG | — | — | — | — | — | — | 4.0 | — | — |
| Builder Agglomerates | | | | | | | | | |
| SKS-6 | 6.0 | — | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| effervescence granule | — | 4.0 | 10.0 | 4.0 | 25 | 8.0 | 12.0 | 2.0 | 4.0 |
| QEA | — | — | — | 0.2 | 0.5 | — | — | — | — |
| NACAOBS | 3.0 | — | — | 4.5 | — | — | — | 2.5 | — |
| NOBS | 1.0 | 3.0 | 3.0 | — | — | — | — | — | 5.0 |
| TAED I | 2.5 | — | — | 1.5 | 2.5 | 6.5 | — | 1.5 | — |
| MBAS | — | — | — | 8.0 | — | — | 8.0 | — | 4.0 |
| LAS (flake) | 10.0 | 10.0 | — | — | — | — | — | 8.0 | — |
| Citric acid II | — | — | — | | | | | | |
| Spray-on | | | | | | | | | |
| Brightener | 0.2 | 0.2 | 0.3 | 0.1 | 0.2 | 0.1 | — | 0.6 | 0.3 |
| Dye | — | — | — | 0.3 | 0.05 | 0.1 | — | — | — |
| AE7 | — | — | — | — | — | 0.5 | — | 0.7 | — |
| Perfume | 1.0 | 0.5 | 1.1 | 0.8 | 0.3 | 0.5 | 0.3 | 0.5 | — |

TABLE I-continued

The following compositions are in accordance with the invention.

| | A | B | C | D | E | F | G | H | I |
|---|---|---|---|---|---|---|---|---|---|
| Dry-add | | | | | | | | | |
| Citrate | — | — | 20.0 | 4.0 | — | 5.0 | 15.0 | — | 5.0 |
| Percarbonate | 15.0 | 3.0 | 6.0 | 10.0 | — | — | 24.0 | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.3 | 0.3 | 0.5 | 0.5 | 0.8 | 2.0 | 0.5 | 0.16 | 0.2 |
| Carbonate | 0.0 | 10.0 | — | — | — | 5.0 | 8.0 | 10.0 | 5.0 |
| Perfume (encapsulated) | — | 0.5 | 0.5 | — | 0.3 | — | 0.2 | — | — |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid (I or coarse) | — | — | — | 6.0 | 6.0 | — | — | — | 5.0 |
| Dyed carbonate (blue, green) | 0.5 | 0.5 | 1.0 | 2.0 | — | 0.5 | 0.5 | 0.5 | 1.0 |
| SKS-6 | — | — | — | 4.0 | — | — | — | 6.0 | — |
| Fillers up to 100% | | | | | | | | | |

TABLE II

The following compositions are in accordance with the invention.

| | A | B | C | D | E | F | G | H | I |
|---|---|---|---|---|---|---|---|---|---|
| Spray-Dried Granules | | | | | | | | | |
| LAS or LAS (I) | 10.0 | 10.0 | 16.0 | 5.0 | 5.0 | 10.0 | — | — | — |
| TAS | — | 1.0 | — | | | | — | — | — |
| MBAS | — | — | — | 5.0 | 5.0 | | — | — | — |
| $C_{45}AS$ | — | — | 1.0 | | 2.0 | 2.0 | — | — | — |
| $C_{45}AE_3S$ | — | — | — | 1.0 | | | — | — | — |
| QAS or QAS 1 | 1.0 | 0.8 | 1.0 | 1.0 | 2.0 | 4.0 | 1.0 | 0.5 | 0.8 |
| DTPA, HEDP and/or EDDS | 0.3 | 0.3 | 0.3 | 0.3 | | | — | — | — |
| MgSO4 | 0.5 | 0.4 | 0.1 | — | | | — | — | — |
| Sodium citrate | 10.0 | 12.0 | 17.0 | 3.0 | 5.0 | | — | — | — |
| Sodium carbonate | 15.0 | 8.0 | 15.0 | | | 10.0 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | — | — | — | 2.0 | — | — | — | — | — |
| SKS-6 | — | — | — | 3.0 | 5.0 | — | — | — | — |
| MA/AA or AA | 1.0 | 2.0 | 10.0 | — | — | 2.0 | — | — | — |
| PEG 4000 | — | 2.0 | — | 1.0 | — | 1.0 | — | — | — |
| QEA | 1.0 | — | — | — | 1.0 | — | — | — | 0.5 |
| Brightener | 0.05 | 0.05 | 0.05 | — | 0.05 | — | — | — | — |
| Silicone oil | 0.01 | 0.01 | 0.01 | — | — | 0.01 | — | — | — |
| HMC | 0.5 | 1.2 | 2.0 | 1.5 | 3.0 | 4.0 | 0.6 | 1.6 | 1.0 |
| Agglomerate | | | | | | | | | |
| LAS | — | — | — | — | — | — | 2.0 | 2.0 | — |
| MBAS | — | — | — | — | — | — | — | — | 1.0 |
| $C_{45}AS$ | — | — | — | — | — | — | 2.0 | — | — |
| CABP | — | — | — | — | — | 1.0 | 0.2 | — | 0.5 |
| Carbonate | — | — | — | — | 4.0 | 1.0 | 1.0 | 1.0 | — |
| Sodium citrate | — | — | — | — | — | — | — | — | 5.0 |
| CFAA | — | — | — | | — | — | — | — | — |
| Citric acid | — | — | — | — | — | 4.0 | — | 1.0 | 1.0 |
| QEA | — | — | — | — | — | 2.0 | 2.0 | 1.0 | — |
| SRP | — | — | — | — | — | 1.0 | 1.0 | 0.2 | — |
| Zeolite A | — | — | — | — | — | 15.0 | 26.0 | 15.0 | 16.0 |
| Sodium silicate | — | — | — | — | — | — | — | — | — |
| PEG | — | — | — | — | — | — | 4.0 | — | — |
| TAED II | | | | | | | 3.0 | | 1.5 |
| Builder Agglomerate | | | | | | | | | |
| SKS-6 | 6.0 | 5.0 | — | — | 6.0 | 3.0 | — | 7.0 | 10.0 |
| LAS | 4.0 | 5.0 | — | — | 5.0 | 3.0 | — | 10.0 | 12.0 |
| Dry-add particulate components | | | | | | | | | |
| Effervescence granule | — | 10.0 | 4.0 | 5 | 15 | 8.0 | 2.0 | 20 | 4.0 |
| NACAOBS | 3.0 | — | — | 1.5 | — | — | — | 5.5 | — |
| NOBS/LOBS/DOBS | — | 3.0 | 3.0 | — | — | — | — | — | 5.0 |
| TAED I | 2.5 | — | — | 1.5 | 2.5 | 6.5 | — | 1.5 | — |
| HMC | — | — | — | 0.7 | — | — | 1.0 | — | 0.5 |
| LAS (flake) | — | — | — | — | — | — | — | 8.0 | — |

TABLE II-continued

The following compositions are in accordance with the invention.

| | A | B | C | D | E | F | G | H | I |
|---|---|---|---|---|---|---|---|---|---|
| Spray-on | | | | | | | | | |
| Brightener | 0.2 | 0.2 | 0.3 | 0.1 | 0.2 | 0.1 | — | 0.6 | — |
| Dye | — | — | — | 0.3 | 0.05 | 0.1 | — | — | — |
| AE7 | — | — | — | — | — | 0.5 | — | 0.7 | — |
| Perfume | — | — | — | 0.8 | — | 0.5 | 0.8 | 0.5 | 1.0 |
| Dry-add | | | | | | | | | |
| QEA | — | — | — | 0.2 | 0.5 | — | — | — | — |
| Citrate | 4.0 | — | 3.0 | 4.0 | — | 5.0 | 15.0 | — | 5.0 |
| Percarbonate | 15.0 | 3.0 | 6.0 | 10.0 | — | — | 12.0 | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.5 | 0.3 | 0.5 | 0.5 | 0.8 | 2.0 | 0.5 | 0.16 | 0.2 |
| Carbonate II | — | — | — | — | — | 5.0 | 8.0 | 10.0 | 5.0 |
| Perfume (encapsulated) | 0.6 | 0.5 | 0.5 | — | 0.3 | 0.5 | 0.2 | 0.1 | 0.6 |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid II | — | — | — | — | — | — | — | 5.0 | 5.0 |
| Dyed carbonate (blue, green) | 0.5 | 0.5 | ? | 2.0 | — | 0.5 | 0.5 | 0.5 | 1.0 |
| SKS-6 | — | — | — | 4.0 | — | — | — | 6.0 | — |
| Fillers up to 100% | | | | | | | | | |

TABLE III

The following are high density and bleach-containing detergent formulations according to the present invention:

| | A | B | C |
|---|---|---|---|
| Blown Powder | | | |
| Zeolite A | — | — | 15.0 |
| QASA | — | 2.5 | — |
| LAS | 3.0 | — | 3.0 |
| C45AS | 3.0 | 2.0 | 4.0 |
| QAS | — | — | 1.5 |
| DTPMP | 0.4 | 0.4 | 0.4 |
| CMC | 0.4 | 0.4 | 0.4 |
| MA/AA | 4.0 | 2.0 | 2.0 |
| HMC | 2.0 | — | 1.5 |
| CABP | 0.8 | 1.0 | 0.5 |
| Agglomerates | | | |
| HMC | 2.0 | 2.0 | 1.0 |
| QAS | 1.0 | — | — |
| LAS | — | 11.0 | 7.0 |
| TAS | 2.0 | 2.0 | 1.0 |
| Silicate | 3.0 | — | 4.0 |
| Zeolite A | 8.0 | 8.0 | 8.0 |
| Carbonate | 8.0 | 8.0 | 4.0 |
| Agglomerate | | | |
| NaSKS-6 (I) or (II) | 15.0 | 12.0 | 5.0 |
| LAS | 8.0 | 7.0 | 4.0 |
| AS | 5.0 | — | — |
| Spray On | | | |
| Perfume | 0.3 | 0.3 | 0.3 |
| C25E3 | 2.0 | — | 2.0 |
| brightener | 0.1 | 0.4 | |
| photobleach | 0.03 | 0.05 | — |
| Dry additives | | | |
| QEA | 1.0 | 2.0 | — |
| Citric acid I | 5.0 | — | 2.0 |
| Bicarbonate I | — | 3.0 | — |
| Carbonate II | 8.0 | 15.0 | 10.0 |
| NAC OBS | 6.0 | — | 5.0 |
| Manganese catalyst | — | — | 0.3 |
| TAED I | | 3.0 | — |

TABLE III-continued

The following are high density and bleach-containing detergent formulations according to the present invention:

| | A | B | C |
|---|---|---|---|
| NOBS | — | 2.0 | — |
| Percarbonate | 14.0 | 7.0 | 10.0 |
| Polyethylene oxide of MW 5,000,000 | — | — | 0.2 |
| Bentonite clay | — | — | 10.0 |
| effervescence granule | — | 5.5 | 7.5 |
| Protease | 1.0 | 1.0 | 1.0 |
| Lipase | 0.4 | 0.4 | 0.4 |
| Amylase | 0.6 | 0.6 | 0.6 |
| Cellulase | 0.6 | 0.6 | 0.6 |
| Silicone antifoam | 5.0 | 5.0 | 5.0 |
| CMC | 1.0 | 0.5 | 1.0 |
| Balance (Moisture and Miscellaneous) | 100.0 | 100.0 | 100.0 |
| Density (g/liter) | 850 | 850 | 850 |

TABLE IV

The following liquid composition is in accord with the invention

| Component | Wt. % | Wt. % | Wt. % | Wt. % |
|---|---|---|---|---|
| $C_{12-15}$ alkyl ether (2.5) sulfate | 38 | 38 | 38 | 38 |
| $C_{12}$ glucose amide | 6.86 | 6.86 | 6.86 | 6.86 |
| Citric Acid | 4.75 | 4.75 | 4.75 | 4.75 |
| $C_{12-14}$ Fatty Acid | 2.00 | 2.00 | 2.00 | 2.00 |
| Enzymes | 1.02 | 1.02 | 1.02 | 1.02 |
| MEA | 1.0 | 1.0 | 1.0 | 1.0 |
| Propanediol | 0.36 | 0.36 | 0.36 | 0.36 |
| Borax | 6.58 | 6.58 | 6.58 | 6.58 |
| Dispersant | 1.48 | 1.48 | 1.48 | 1.48 |
| Na Toluene Sulfonate | 6.25 | 6.25 | 6.25 | 6.25 |
| QAS or QAS 1 | 1.0 | 1.0 | — | 1.0 |
| QASA or QASA 1 | 2.0 | 2.0 | 2.0 | — |

TABLE IV-continued

| The following liquid composition is in accord with the invention | | | | |
|---|---|---|---|---|
| Component | Wt. % | Wt. % | Wt. % | Wt. % |
| QEA or CABP | — | — | 1.0 | 0.5 |
| HMC | 0.5 | 1.8 | 2.0 | 0.8 |
| CMC or AC | 1.0 | 1.0 | 2.0 | — |
| Dye, Perfume, Brighteners, Preservatives, Suds Suppressor, Other Minors, Water | Balance | Balance | Balance | Balance |
| | 100% | 100% | 100% | 100% |

TABLE V

| The following liquid detergent formulations are prepared according to the present invention | | | | | |
|---|---|---|---|---|---|
| | A | B | C | D | E |
| LAS | 11.5 | 9.0 | — | 4.0 | — |
| C25E2.5S | — | 3.0 | 18.0 | — | 16.0 |
| C45E2.25S | 11.5 | 3.0 | — | 16.0 | — |
| C23E9 | — | 3.0 | 2.0 | 2.0 | 1.0 |
| C23E7 | 3.2 | — | — | — | — |
| CFAA | — | — | 5.0 | — | 3.0 |
| TPKFA | 2.0 | — | 2.0 | 0.5 | 2.0 |
| Citric (50%) | 6.5 | 1.0 | 2.5 | 4.0 | 2.5 |
| Ca formate | 0.1 | 0.06 | 0.1 | — | — |
| Na formate | 0.5 | 0.06 | 0.1 | 0.05 | 0.05 |
| STS | 4.0 | 1.0 | 3.0 | 1.2 | — |

TABLE V-continued

| The following liquid detergent formulations are prepared according to the present invention | | | | | |
|---|---|---|---|---|---|
| | A | B | C | D | E |
| Borate | 0.6 | — | 3.0 | 2.0 | 3.0 |
| Na hydroxide | 6.0 | 2.0 | 3.5 | 4.0 | 3.0 |
| Ethanol | 2.0 | 1.0 | 4.0 | 4.0 | 3.0 |
| 1,2 Propanediol | 3.0 | 2.0 | 8.0 | 8.0 | 5.0 |
| Monoethanol-amine | 3.0 | 1.5 | 1.0 | 2.5 | 1.0 |
| HMC | 2.0 | 1.0 | 1.0 | 3.0 | 0.4 |
| QAS 1 or QAS | — | 1.0 | 2.0 | 0.8 | 1.0 |
| Protease | 0.03 | 0.01 | 0.03 | 0.02 | 0.02 |
| Lipase | — | — | 0.002 | — | — |
| Amylase | — | — | — | 0.002 | — |
| Cellulase | — | — | 0.0002 | 0.0005 | 0.0001 |
| CMC | 0.2 | — | 0.5 | — | 1.0 |
| DTPA | — | — | 0.3 | — | — |
| PVNO | — | — | 0.3 | — | 0.2 |
| QASA or QASA 1 | 0.9 | 1.7 | 0.5 | | — |
| Silicone anti-foam | 0.04 | 0.02 | 0.1 | 0.1 | 0.1 |
| | | | | | Miscellaneous and water |

TABLE VI

| The following liquid detergent formulations are according to the present invention | | | | | | | | |
|---|---|---|---|---|---|---|---|---|
| | A | B | C | D | E | F | G | H |
| LAS | 10.0 | 13.0 | 9.0 | — | 25.0 | — | — | — |
| C25AS | 4.0 | 1.0 | 2.0 | 10.0 | — | 13.0 | 18.0 | 15.0 |
| C25E3S | 1.0 | — | — | 3.0 | — | 2.0 | 2.0 | 4.0 |
| C25E7 | 6.0 | 8.0 | 13.0 | 2.5 | — | — | 4.0 | 4.0 |
| TFAA | — | — | — | 4.5 | — | 6.0 | 8.0 | 8.0 |
| APA | — | 1.4 | — | — | 3.0 | 1.0 | 2.0 | — |
| TPKFA | 2.0 | — | 13.0 | 7.0 | — | 15.0 | 11.0 | 11.0 |
| Citric | 2.0 | 3.0 | 1.0 | 1.5 | 1.0 | 1.0 | 1.0 | 1.0 |
| Dodecenyl/tetradecenyl succinic acid | 12.0 | 10.0 | — | — | 15.0 | — | — | — |
| Rapeseed fatty acid | 4.0 | 2.0 | 1.0 | — | 1.0 | — | 3.5 | — |
| Ethanol | 4.0 | 4.0 | 7.0 | 2.0 | 7.0 | 2.0 | 3.0 | 2.0 |
| 1,2 Propanediol | 4.0 | 4.0 | 2.0 | 7.0 | 6.0 | 8.0 | 10.0 | 13.0 |
| Monoethanolamine | — | — | — | 5.0 | — | — | 9.0 | 9.0 |
| Triethanolamine | — | — | 8.0 | — | — | — | 0.4 | 0.3 |
| HMC | 0.2 | 2.0 | 0.5 | 0.7 | 2.0 | 1.2 | 1.0 | 4.0 |
| QAS or QAS 1 | 0.3 | 0.4 | 0.5 | 1.0 | 1.0 | 2.0 | 0.5 | 1.0 |
| QASA | 1.0 | 1.0 | 0.5 | | | 0.5 | | 1.0 |
| Carbohydrase | | | | | 0.08 | 0.02 | 0.01 | 0.02 |
| Protease | 0.02 | 0.02 | 0.01 | .008 | — | — | .003 | .003 |
| Lipase | — | .002 | — | .002 | .004 | 0.01 | 0.01 | 0.01 |
| Amylase | .004 | .004 | 0.01 | .008 | — | — | .004 | .003 |
| Cellulase | — | — | — | .002 | — | — | 0.2 | 0.1 |
| QEA or CABP | 0.3 | — | 0.3 | — | 1.0 | 1.5 | — | — |
| Boric acid | 0.1 | 0.2 | 1.0 | 2.0 | 4.0 | 4.0 | — | — |
| Ca chloride | — | 0.02 | — | 0.01 | 0.1 | 0.2 | 0.3 | — |
| Brightener 1 | — | 0.4 | — | — | 0.4 | — | — | — |
| Suds suppressor | 0.1 | 0.3 | — | 0.1 | 0.8 | 0.7 | — | — |

TABLE VI-continued

| The following liquid detergent formulations are according to the present invention | | | | | | | | |
|---|---|---|---|---|---|---|---|---|
| | A | B | C | D | E | F | G | H |
| Opacifier | 0.5 | 0.4 | — | 0.3 | 8.0 | 7.5 | 8.0 | 8.2 |
| NaOH up to pH | 8.0 | 8.0 | 7.6 | 7.7 | | | | Miscellaneous and water |

What is claimed is:

1. A detergent composition or component comprising:

a) from 0.01% to 90% by weight of a salt of a quatemary ammonium compound; and b) from 0.01%to 90% by weight of a hydrophobically modified cellulosic polymer, wherein the quaternary ammonium compound and the hydrophobically modified cellulosic material are in the form of an agglomerate, a compacted granule a spray dried granule, or a mixture thereof.

2. A detergent composition or component according to claim 1 wherein the cellulosic polymer is of the formula

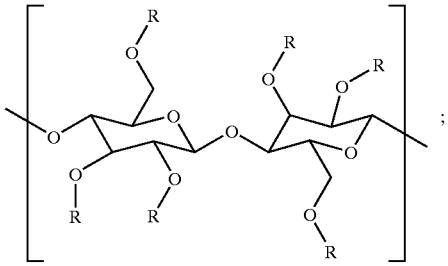

wherein each R is selected from the group consisting of $R_2$, $R_C$, and

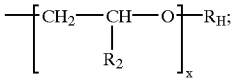

wherein:

each $R_2$ is independently selected from the group consisting of H and $C_1$–$C_4$ alkyl;

each $R_C$ is

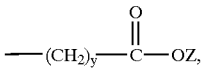

wherein each Z is independently selected from the group consisting of M, $R_2$, $R_C$, and $R_H$;

each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2$N-alkyl, $(R_4)_2$N-2-hydroxyalkyl, $(R_4)_3$N-alkyl, $(R_4)_3$N-2-hydroxyalkyl, $C_6$–$C_{12}$ aryloxy-2-hydroxyalkyl,

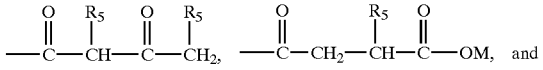

-continued

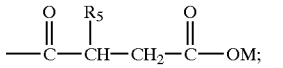

each $R_4$ is independently selected from the group consisting of H, $C_1$–$C_{20}$ alkyl, $C_5$–$C_7$ cycloalkyl, $C_7$–$C_{20}$ alkylaryl, $C_7$–$C_{20}$ arylalkyl, aminoalkyl, alkylaminoalkyl, dialkylaminolalkyl, piperidinoalkyl, morpholinoalkyl, cycloalkylaminoalkyl and hydroxyalkyl;

each $R_5$ is independently selected from the group consisting of H, $C_1$–$C_{20}$ alkyl, $C_5$–$C_7$ cycloalkyl, $(R_4)_2$N-alkyl, and $(R_4)_3$N-alkyl;

wherein:

M is a suitable cation selected from the group consisting of Na, K, 1/2Ca, and 1/2Mg;

each x is from 0 to 5;

each y is from 1 to 5; and provided that:

the Degree of Substitution for group $R_H$ is between 0.001 and 0.1;

the Degree of Substitution for group $R_C$ wherein Z is H or M is between 0.2 and 2.0;

if any $R_H$ bears positive charge, it is balanced by a suitable anion; and two $R_4$×on the same nitrogen can together form a ring structure selected from the group consisting of piperidine and morpholine.

3. A composition or component according to claim 2, wherein each $R_H$ is independently selected from the group consisting of $C_5$–$C_{20}$ alkyl, $C_5$–$C_7$ cycloalkyl, $C_7$–$C_{20}$ alkylaryl, $C_7$–$C_{20}$ arylalkyl, substituted alkyl, hydroxyalkyl, $C_1$–$C_{20}$ alkoxy-2-hydroxyalkyl, $C_7$–$C_{20}$ alkylaryloxy-2-hydroxyalkyl, $(R_4)_2$N-alkyl, $(R_4)_2$N-2-hydroxyalkyl, $(R_4)_3$N-alkyl, $(R_4)_3$N-2-hydroxyalkyl, and $C_6$–$C_{12}$ aryloxy-2-hydroxyalkyl.

4. A composition or component according to claim 2, wherein each $R_H$ is independently selected from the group consisting of

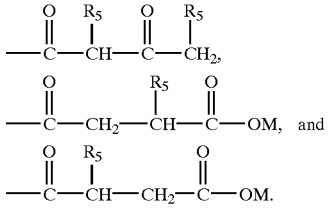

5. A detergent component or composition according to claim 1 wherein the quaternary ammonium compound is selected from quaternary ammonium surfactants, quaternary ammonium softeners, quaternary ammonium dispersants and mixtures thereof.

6. A component or composition according claim 5 comprising a cationic surfactant containing at least a quatemary mono-alkoxylated ammonium surfactants.

7. A opposition or component according to claim 5 whereby the quaternary ammonium compound or compounds and the cellulosic polymer are in an intimate mixture with one another.

8. A detergent component according to claim 1 obtainable by a process comprised of the steps of mixing the cellulosic polymer and the quaternary ammonium compound or compounds to form an intimate mixture and agglomerating the intimate mixture.

9. A laundry composition or component according to claim 1 which also comprises a cyclic amine based polymer.

* * * * *